US009381390B1

(12) United States Patent
Roch

(10) Patent No.: US 9,381,390 B1
(45) Date of Patent: Jul. 5, 2016

(54) APPLIANCE SAFETY DEVICE

(71) Applicant: Adam Roch, Chadds Ford, PA (US)

(72) Inventor: Adam Roch, Chadds Ford, PA (US)

( * ) Notice: Subject to any disclaimer, the term of this patent is extended or adjusted under 35 U.S.C. 154(b) by 0 days.

(21) Appl. No.: 14/682,510

(22) Filed: Apr. 9, 2015

(51) Int. Cl.

| | |
|---|---|
| ***A62C 13/62*** | (2006.01) |
| ***A62C 37/40*** | (2006.01) |
| ***D06F 95/00*** | (2006.01) |
| ***A62C 3/00*** | (2006.01) |
| ***A62C 35/68*** | (2006.01) |

(52) U.S. Cl.
CPC . *A62C 37/40* (2013.01); *A62C 3/00* (2013.01); *A62C 35/68* (2013.01); *D06F 95/00* (2013.01)

(58) Field of Classification Search
CPC ..... A62C 3/006; A62C 37/12; A62C 37/14; A62C 37/36
USPC ..... 169/65, 54, 60, 68
See application file for complete search history.

(56) References Cited

U.S. PATENT DOCUMENTS

| | | | | |
|---|---|---|---|---|
| 4,524,835 | A * | 6/1985 | Mingrone | A62C 3/04 138/37 |
| 4,539,898 | A * | 9/1985 | Bishop | A47J 36/38 169/65 |
| 4,830,116 | A * | 5/1989 | Walden | A63C 3/006 169/17 |
| 5,353,880 | A | 10/1994 | Green | |
| 5,511,535 | A | 4/1996 | Landstrom et al. | |
| 5,697,450 | A * | 12/1997 | Stehling | A62C 3/006 169/65 |
| 7,789,165 | B1 * | 9/2010 | Yen | A47J 37/1266 126/374.1 |
| 8,157,020 | B1 | 4/2012 | Bass | |

* cited by examiner

*Primary Examiner* — Davis Hwu
(74) *Attorney, Agent, or Firm* — Crossley & Stevenson Intellectual Property Law

(57) ABSTRACT

The appliance safety device provides a spray of a liquid, typically a water, both above and below an appliance deemed capable of catching fire. The device also retaliates against either the appliance or the liquid release that can harm a surrounding environment. The device automatically senses an excessive heat and triggers the spray over and under the appliance, with a pan positioned below the appliance to capture the spray. Water buildup within the pan is automatically sensed and a pump triggered to evacuate the pan through a drain line into a drain.

8 Claims, 6 Drawing Sheets

APPLIANCE SAFETY DEVICE

BACKGROUND OF THE INVENTION

Some appliances are known to catch fire from excessive heat buildup, such as a clothes dryer when a vent hose is clogged. Also, clothes washing machines, for example, can flood a laundry room and a plurality of other rooms when a drain clogs or the machine malfunctions. An appliance repairman is quite familiar with these problems. While flooding is often costly and time consuming in associated repairs, a fire is considered by all an extremely serious event. What has been needed is a device that automatically negates these problems by spraying water on a fire, or even an excessively heated dryer, for example, and by capturing and draining water from a washing machine, as well as performing these same functions for other apparatus and appliances, such as outdoor cookers. The present appliance safety device performs these needed functions.

FIELD OF THE INVENTION

The present appliance safety device relates to guarding against fire and water dispersal with a plurality of existing appliances.

SUMMARY OF THE INVENTION

The general purpose of the appliance safety device, described subsequently in greater detail, is to provide an appliance safety device that has many novel features that result in an appliance safety device which is not anticipated, rendered obvious, suggested, or even implied by prior art, either alone or in combination thereof.

To accomplish this, the device is configured to partially surround an existing appliance. The device comprises a three-walled pan having a hinged fourth wall and a bottom. The device is also offered with the fourth wall being unhinged. A lock selectively fastens the door. A pump and switch assembly has a vertical float switch, a vertical auxiliary float switch, a pump, and plurality of intakes disposed in the assembly and in the pump. The device is also provided without the hinged door and without the vertical auxiliary float switch. The auxiliary float switch affords added security against flooding in case of a pan overflow due to failure of the vertical float switch. The pump and switch assembly is configured to detect a liquid in the pan and automatically turn on to drain the liquid.

A pan drain line is configured to carry water from the pump and switch assembly. A washer drain line is provided. A Y is configured to transfer the liquid from the pan drain line and the washer drain line to a drain. The device is also provided without the Y. A vent having a heat sensor is connected to a wall of the three-walled pan. A selectively provided lighted stalk is in operational communication with the vent and the heat sensor. A horizontally disposed lower spray supply is in operational communication with the vent and the heat sensor.

A first tee is connected to the lower spray supply. A connect line is connected atop the first tee. A second tee is connected atop the connect line. An L-shaped line is connected atop the second tee. The I-shaped line has a horizontal section. A plurality of equally spaced apart nozzles is disposed in the horizontal section and the lower spray supply. The nozzles are configured to spray downwardly in the horizontal section. The nozzles are configured to spray in0 degree horizontal alternation in the lower spray supply.

A high temperature self-activation valve is connected to the second tee, a supply line, and a capillary tube. The self-activation valve has a plurality of coils75. The capillary tube is connected to a remote sensor. A kill switch is exposed to at least one nozzle. The kill switch is configured to connect to an existing appliance wherein the appliance is switched off upon a spray from the nozzle. The appliance is automatically turned off.

While the appliance safety device is ideal to use with a clothes washer and a dryer, the device is also used with outdoor and indoor cooking devices and a host of other appliances that may catch fire or leak excessively.

Thus has been broadly outlined the more important features of the present appliance safety device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
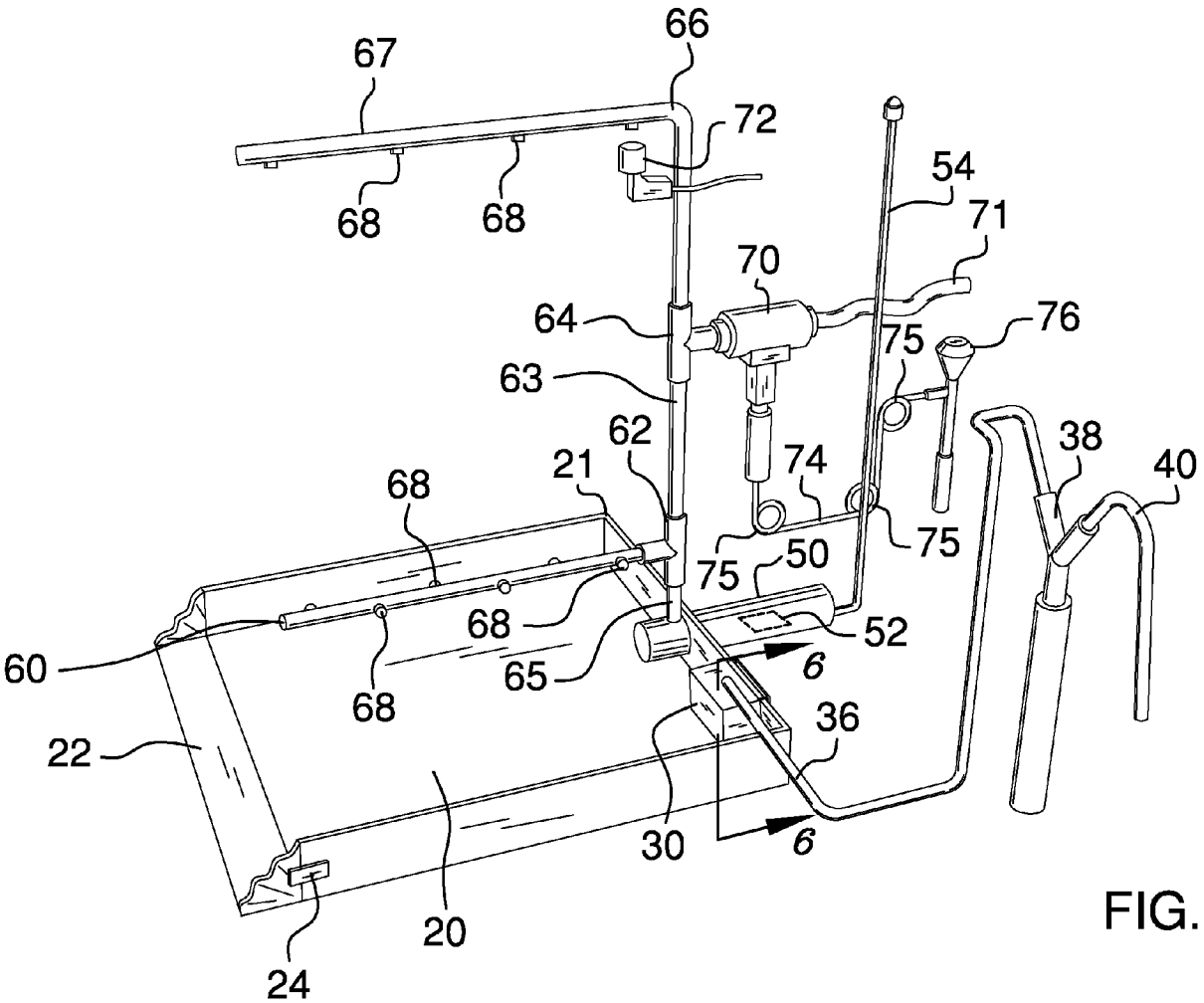
FIG. 1 is a perspective view.
Figure 2:
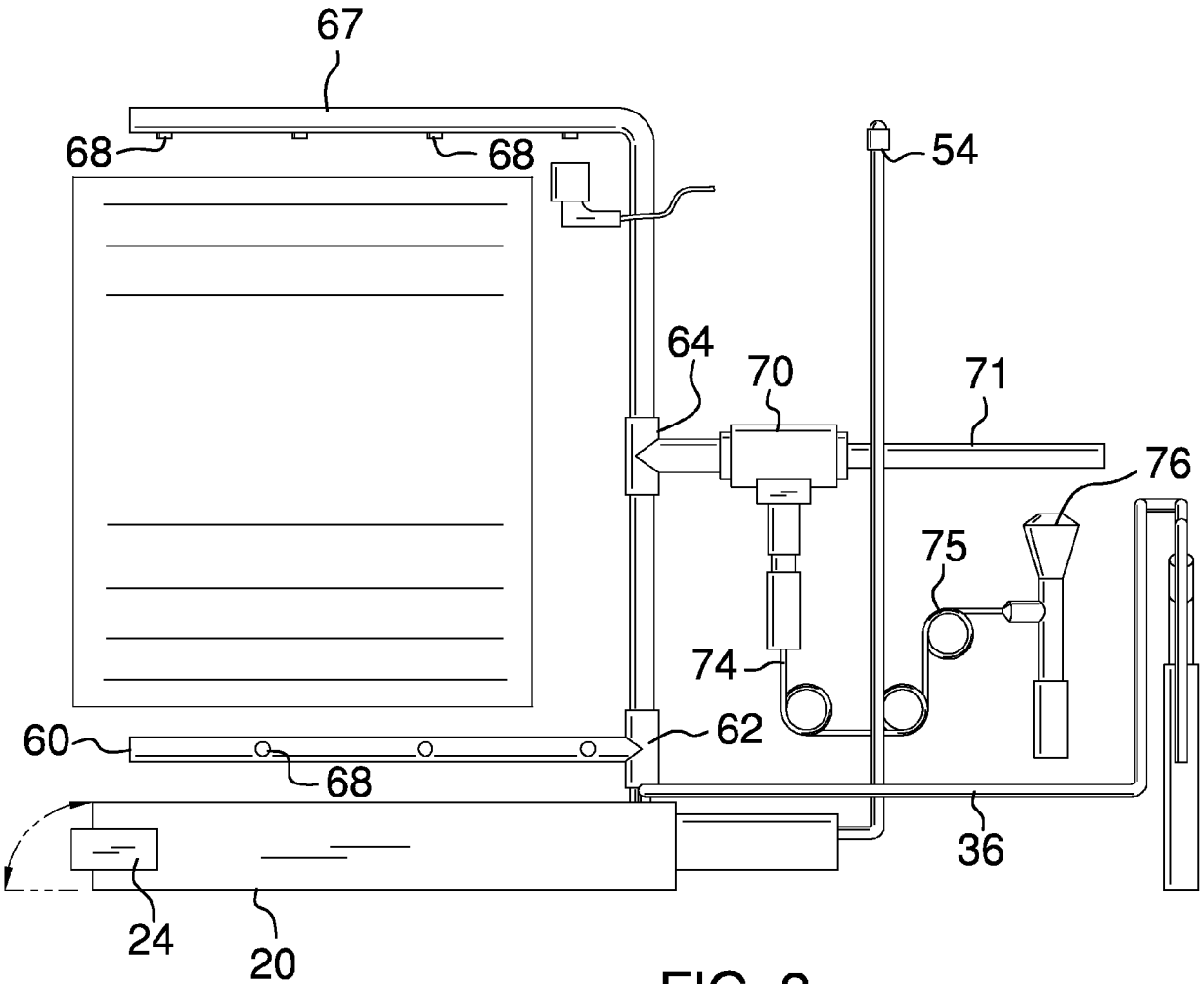
FIG. 2 is a lateral elevation view.
Figure 3:
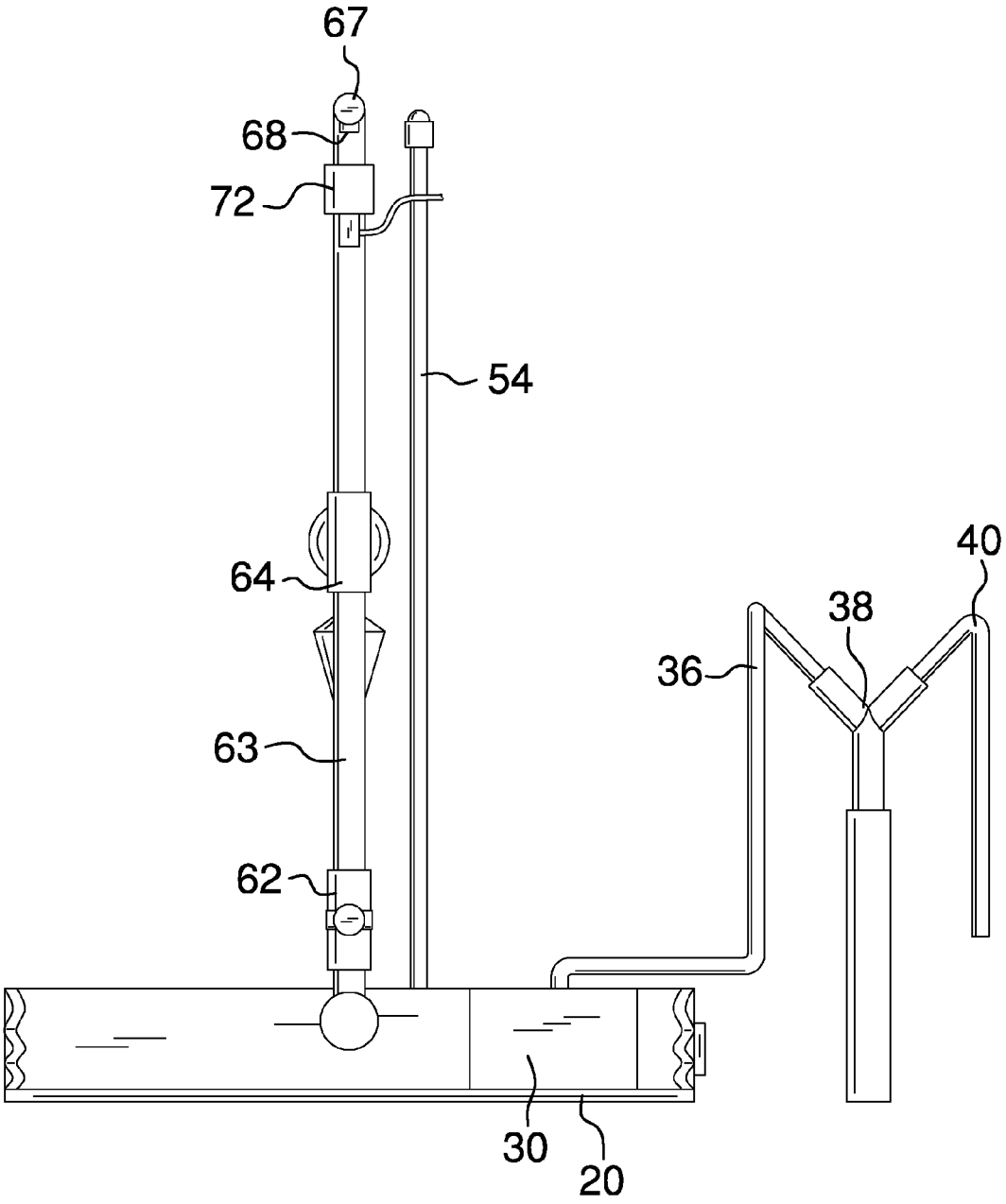
FIG. 3 is a frontal elevation view.
Figure 4:
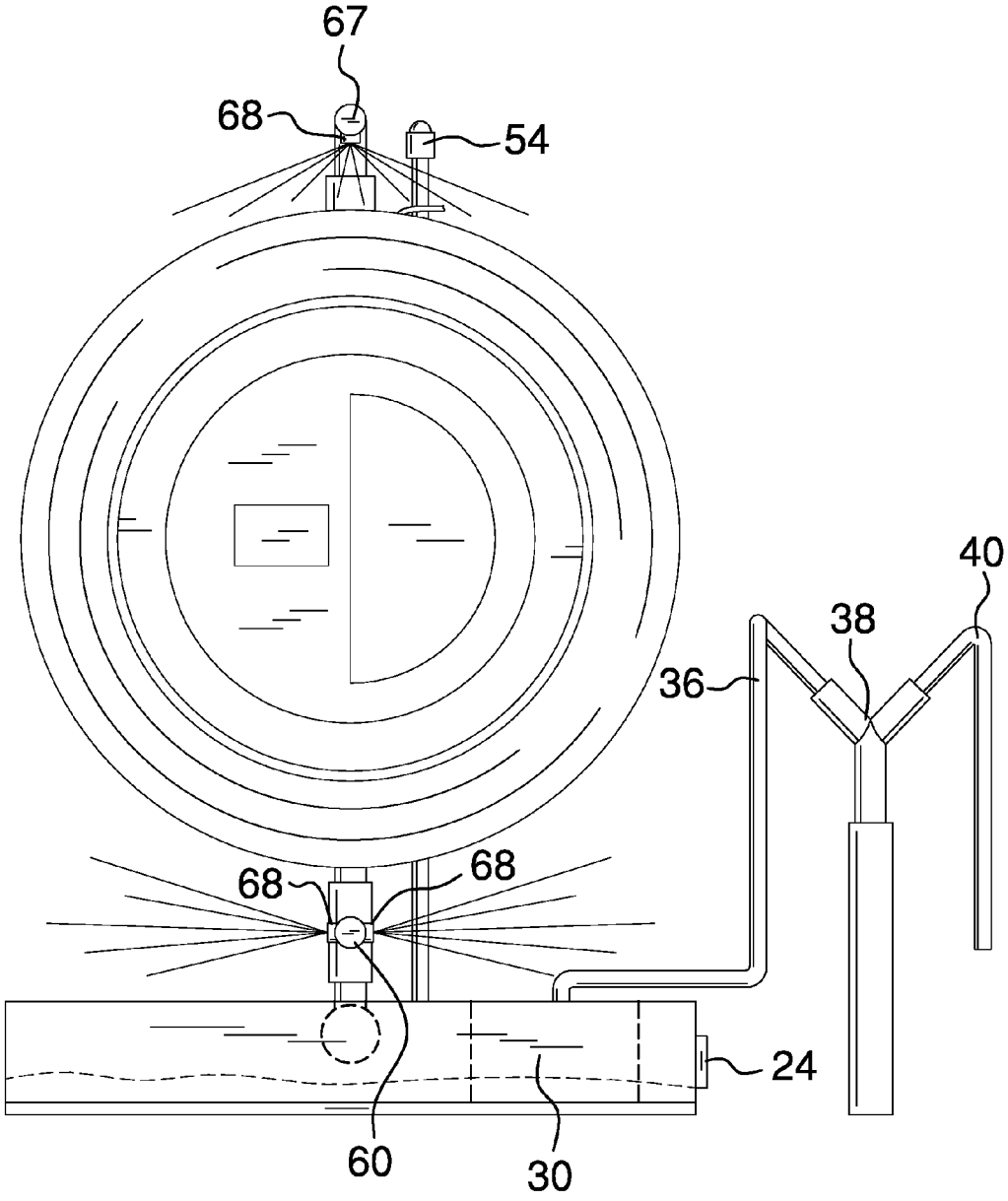
FIG. 4 is frontal in use view.
Figure 5:
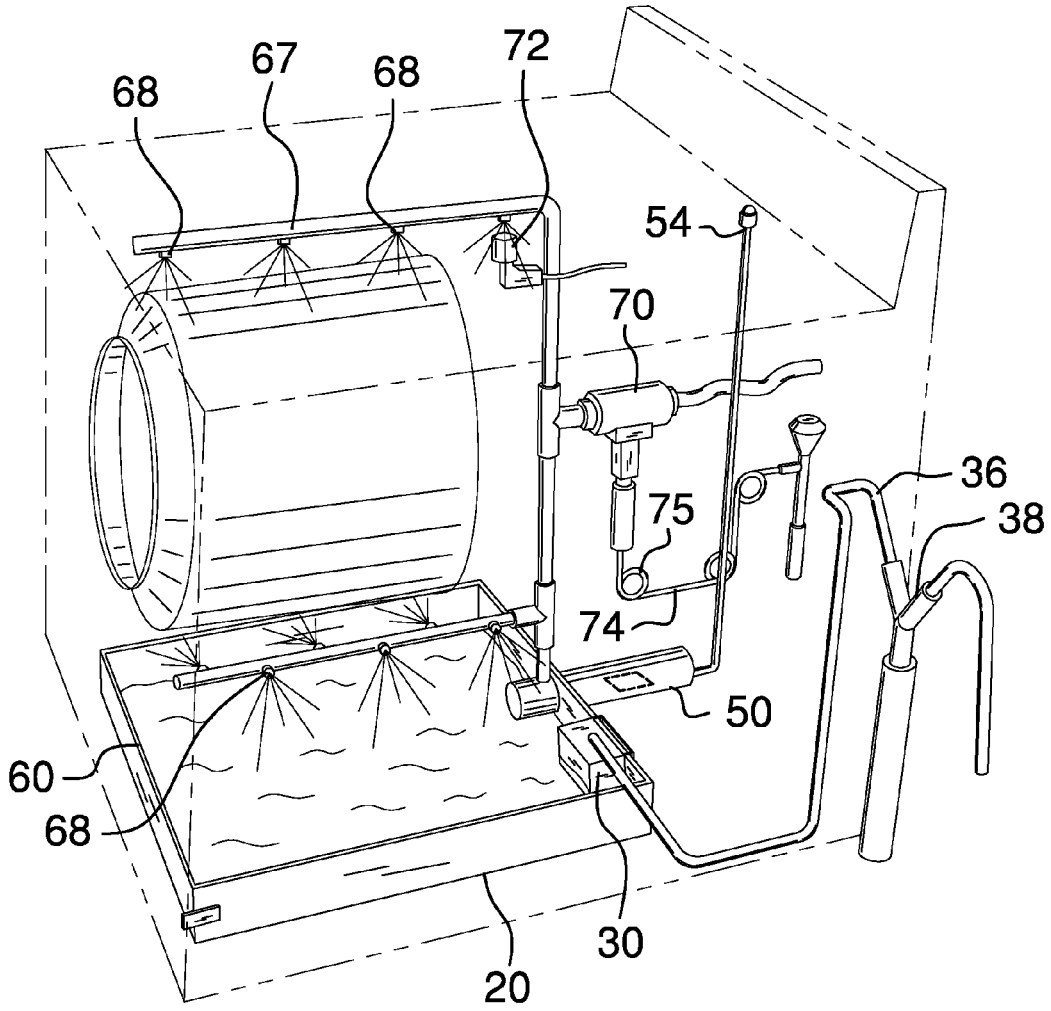
FIG. 5 is a perspective in use view.
Figure 6:
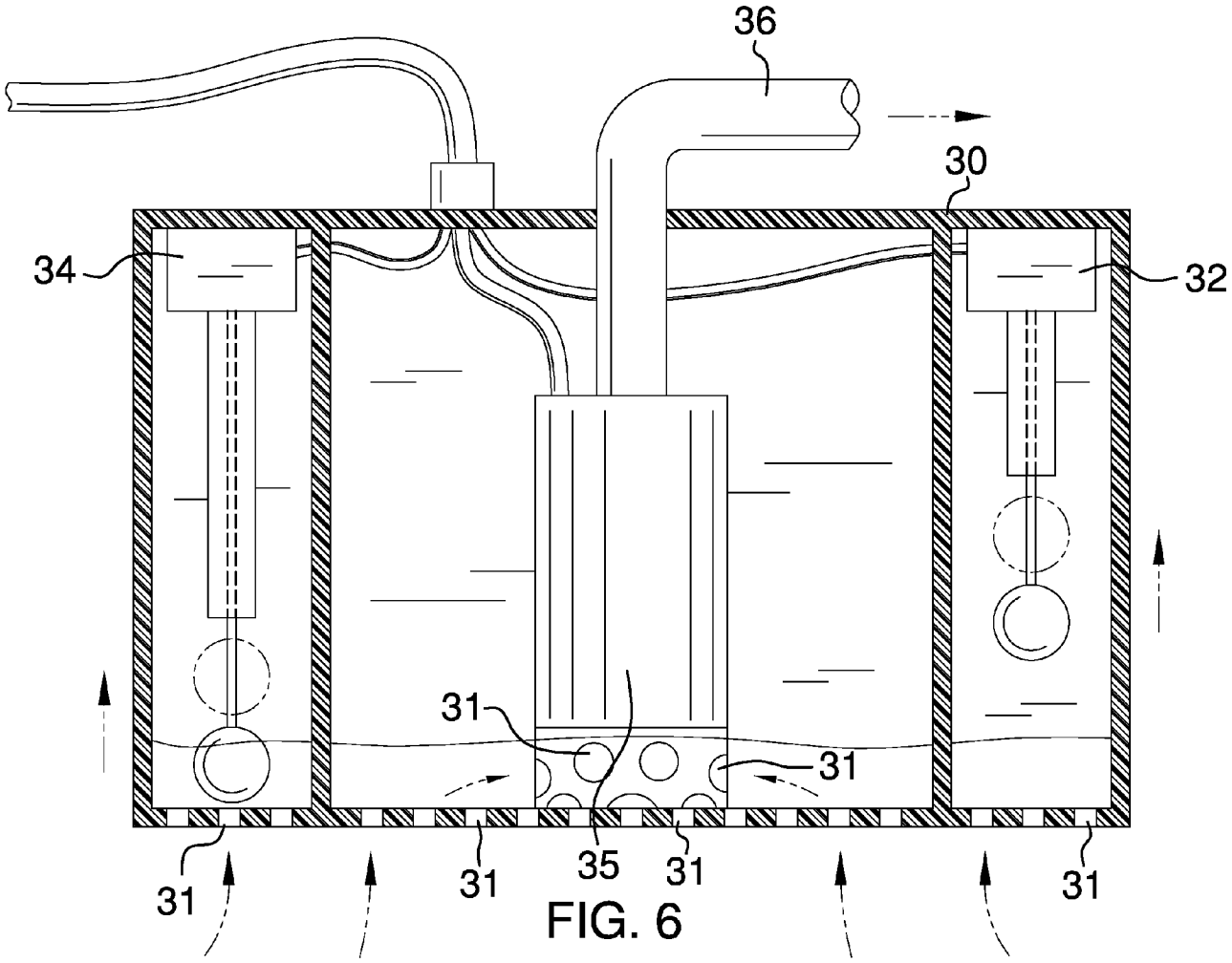
FIG. 6 is a cross sectional view of FIG. 3 taken along line 6-6.

With reference now to the drawings, and in particular FIGS. 1 through 6 thereof, an example of the appliance safety device employing the principles and concepts of the present appliance safety device and generally designated by the reference number 10 will be described.

Referring to FIGS. 1 through 6, the appliance safety device 10 comprises a three-walled pan 20 having a hinged fourth wall 22 and a bottom 23. A lock 24 selectively fastens the door 22 in a closed position. A pump and switch assembly 30 has a vertical float switch 32, an vertical auxiliary float switch 34, a pump 35, and plurality of intakes 31 disposed in the assembly 39 and in the pump 35. The pump and switch assembly 30 is configured to detect a liquid in the pan 20 and automatically turn on to drain the liquid.

A pan drain line 36 is configured to carry water from the pump and switch assembly 30. A washer drain line 40 is provided. A Y 38 is configured to transfer the liquid from the pan drain line 36 and the washer drain line 40 to a drain. A vent 50 has a heat sensor 52 connected to a wall 31 of the three-walled pan 20. A lighted stalk 54 is in operational communication with the vent 50 and the heat sensor 52. A horizontally disposed lower spray supply 60 is in operational communication with the vent 50 and the heat sensor 52.

A first tee 62 is connected to the lower spray supply 60. A connect line 63 is connected atop the first tee 62. A second tee 64 is connected atop the connect line 63. An L-shaped line 66 is connected atop the second tee 64. The I-shaped line 66 has a horizontal section 67. A plurality of equally spaced apart nozzles 68 is disposed in the horizontal section 67 and the lower spray supply 60. The nozzles 68 are configured to spray downwardly in the horizontal section 67. The nozzles 68 are configured to spray in 180 degree horizontal alternation in the lower spray supply 60.

A high temperature self-activation valve 70 is connected to the second tee 64, a supply line 71, and a capillary tube 74.

The self-activation valve 70 has a plurality of coils75. The capillary tube 74 is connected to a remote sensor 76. A kill switch 72 is exposed to at least one nozzle 68. The kill switch 72 is configured to connect to an existing appliance wherein the appliance is switched off upon a spray from the nozzle 68. The appliance is automatically turned off with the kill switch 72 activated.

The pump and switch assembly 30, the heat sensor 52, the lighted stalk 54, the kill switch 72, and the remote sensor 76 are in operational communication and are powered by an existing source. The device 10 is configured to partially surround an existing appliance.

What is claimed is:

1. An appliance safety device comprising:

a walled pan having a bottom;

a pump and switch assembly having a pump, a vertical float switch and a plurality of intakes;

wherein the pump and switch assembly is configured to detect a liquid in the pan and automatically turn on to drain the liquid;

a pan drain line configured to carry water from the pump and switch assembly;

a vent having a heat sensor, the vent connected to a wall of the three-walled pan;

a lighted stalk in operational communication with the vent and the heat sensor;

a horizontally disposed lower spray supply in operational communication with the vent and the heat sensor;

a first tee connected to the lower spray supply;

a connect line connected atop the first tee;

a second tee connected atop the connect line;

an L-shaped line connected atop the second tee, the L-shaped line having a horizontal section;

a plurality of equally spaced apart nozzles disposed in the horizontal section and the lower spray supply, the nozzles configured to spray downwardly in the horizontal section, the nozzles configured to spray in a 180 degree horizontal alternation in the lower spray supply;

a high temperature self-activation valve connected to the second tee;

a supply line connected to the self-activation valve;

a capillary tube connected to the self-activation valve, the capillary tube having a plurality of coils;

a remote sensor connected to the capillary tube; and wherein the appliance is switched off upon a spray from the nozzles;

wherein the pump and switch assembly, the heat sensor, the lighted stalk, and the remote sensor are in operational communication and are powered by an existing power source; and wherein the device is configured to partially surround an existing appliance.

2. The appliance safety device of claim 1 wherein the pan is a three-walled pan having a hinged fourth wall.

3. The appliance safety device of claim 2 having a lock securing the fourth wall.

4. The appliance safety device of claim 1 having a Y configured to transfer the liquid from the pan drain line to a drain;

a washer drain line configured to drain a washer into the Y.

5. The appliance safety device of claim 2 having a Y configured to transfer the liquid from the pan drain line to a drain;

a washer drain line configured to drain a washer into the Y.

6. The appliance safety device of claim 3 having a Y configured to transfer the liquid from the pan drain line to a drain;

a washer drain line configured to drain a washer into the Y.

7. An appliance safety device comprising:

a three-walled pan having a hinged fourth wall and a bottom;

a pump and switch assembly having a pump, a vertical float switch, an auxiliary vertical float switch, and a plurality of intakes;

wherein the pump and switch assembly is configured to detect a liquid in the pan and automatically turn on to drain the liquid;

a pan drain line configured to carry water from the pump and switch assembly;

a washer drain line;

a Y configured to transfer the liquid from the pan drain line and the washer drain line to a drain;

a vent having a heat sensor, the vent connected to a wall of the three-walled pan;

a lighted stalk in operational communication with the vent and the heat sensor;

a horizontally disposed lower spray supply in operational communication with the vent and heat sensor;

a first tee connected to the lower spray supply;

a connect line connected atop the first tee;

a second tee connected atop the connect line;

an L-shaped line connected atop the second tee, the I-shaped line having a horizontal section;

a plurality of equally spaced apart nozzles disposed in the horizontal section and the lower spray supply, the nozzles configured to spray downwardly in the horizontal section, the nozzles configured to spray in a 180 degree alternation in the lower spray supply;

a high temperature self-activation valve connected to the second tee;

a supply line connected to the self-activation valve;

a capillary tube connected to the self-activation valve, the capillary tube having a plurality of coils; and a remote sensor connected to the capillary tube;

wherein the appliance is switched off upon a spray from the nozzles;

wherein the pump and switch assembly, the heat sensor, the lighted stalk, the remote sensor are in operational communication and are powered by an existing power source; and wherein the device is configured to partially surround an existing appliance.

8. The appliance safety device of claim 7 having a kill switch disposed in communication with at least one nozzle, the kill switch configured to connect to the appliance partially surrounded by the device wherein the appliance is switched off.

* * * * *